United States Patent [19]

Furr

[11] 4,356,863

[45] Nov. 2, 1982

[54] TEMPERATURE CONTROL FOR PREHEATING A CRUDE OIL FEEDSTOCK

[75] Inventor: Danny L. Furr, Broken Arrow, Okla.

[73] Assignee: Phillips Petroleum Company, Bartlesville, Okla.

[21] Appl. No.: 184,841

[22] Filed: Sep. 8, 1980

[51] Int. Cl.[3] ..... F28F 27/00

[52] U.S. Cl. ..... 165/1; 165/40; 208/187; 208/251 R; 208/DIG. 1; 236/78 D; 307/141; 318/621

[58] Field of Search ..... 208/187, 251 R, DIG. 1; 165/1, 40; 236/78 D; 318/621, 622; 307/141

[56] References Cited

U.S. PATENT DOCUMENTS

| | | | |
|---|---|---|---|
| 3,126,053 | 3/1964 | Brunner | 165/40 |
| 3,167,113 | 1/1965 | Kleiss | 165/1 |
| 3,172,462 | 3/1965 | Brunner | 165/1 |
| 3,202,208 | 8/1965 | Geiringer | 165/40 X |
| 3,450,105 | 6/1969 | Osburn | 236/20 R |
| 3,628,129 | 12/1971 | Riley | 318/621 X |
| 3,888,760 | 6/1975 | Ebert | 208/187 X |
| 4,069,413 | 1/1978 | Rutledge et al. | 318/621 X |
| 4,087,354 | 5/1978 | Hessler | 208/251 R |
| 4,211,207 | 7/1980 | Molivadas | 165/40 X |

FOREIGN PATENT DOCUMENTS

| | | | |
|---|---|---|---|
| 572639 | 9/1977 | U.S.S.R. | 165/40 |

*Primary Examiner*—Sheldon J. Richter
*Attorney, Agent, or Firm*—French, Hughes and Doescher

[57] ABSTRACT

In a process in which a feedstock is provided through a desalting unit prior to introduction into a fractional distillation column, the feed stream flowing to the desalting unit is split and passed through multiple heat exchangers. Method and apparatus is provided for maintaining a desired effluent flow rate out of the desalting unit and for maintaining the temperatures of the split feed streams substantially equal. After passing through the desalting unit the feed stream may again be split and passed through multiple heat exchangers prior to introduction of the feed stream into the fractional distillation column. Method and apparatus is also provided for maintaining the temperature of the split feed streams provided from the desalting unit substantially equal.

10 Claims, 1 Drawing Figure

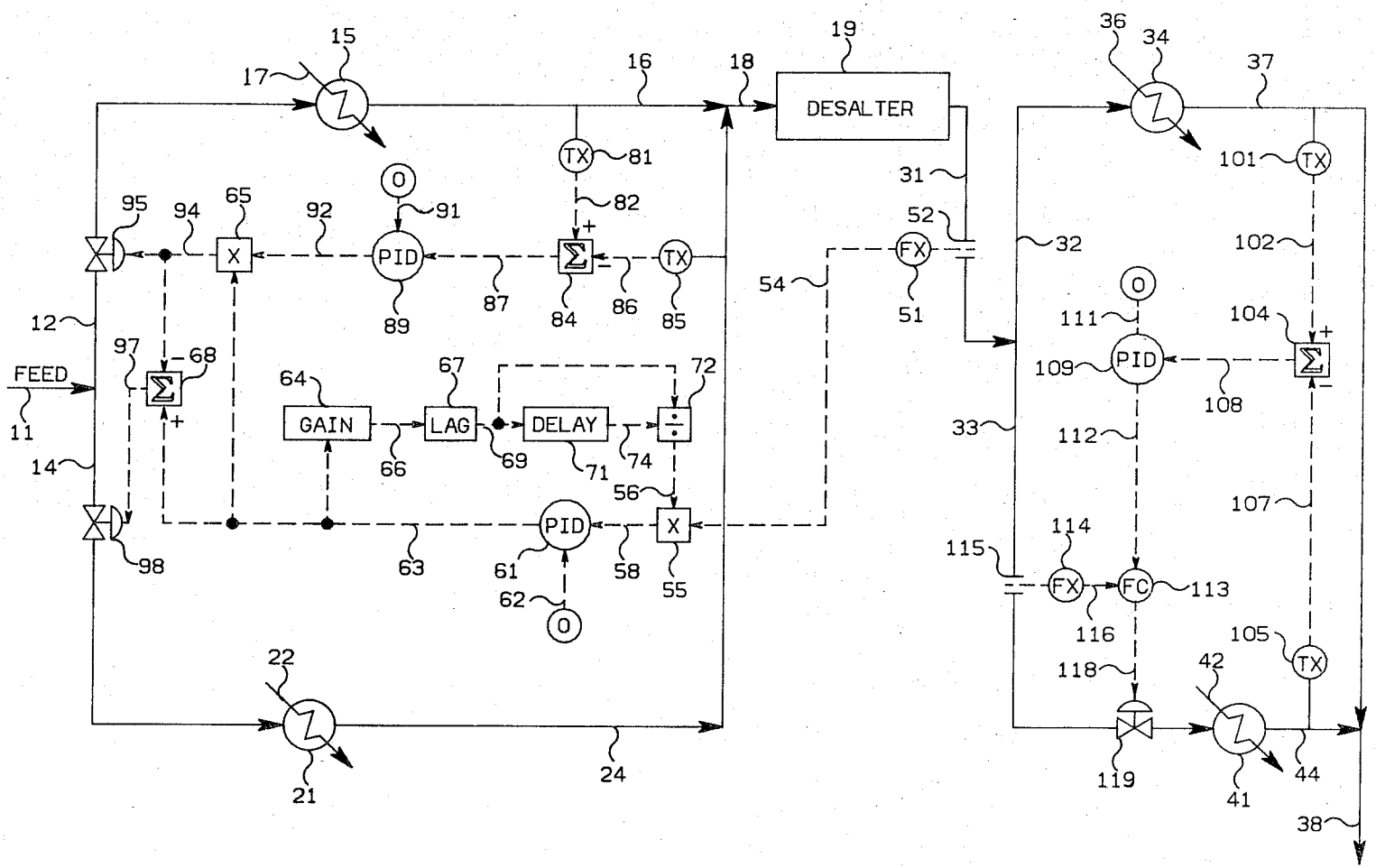
DESALTER
FEED
PID
LAG
GAIN
DELAY
TX
FX
FC
X

TEMPERATURE CONTROL FOR PREHEATING A CRUDE OIL FEEDSTOCK

This invention relates to preheating a crude oil feedstock. In another aspect this invention relates to preheating a crude oil feedstock prior to introduction of the feedstock into a desalting unit. In still another aspect this invention relates to heating the effluent flowing from a desalting unit prior to introduction of the effluent into a fractional distillation column.

Almost all crude oils contain salt. It is well known that it is desirable to remove salt from crude oil prior to introducing the crude oil into a fractional distillation process to prevent corrosion in the fractional distillation column and prevent accumulation of the salt at various points in the fractional distillation column and other parts of the process. Thus, it is common to employ desalting units through which a crude oil is passed prior to introduction of the crude oil into a fractional distillation column.

A desalting process typically requires that the crude oil be preheated to about 250° F. prior to introduction of the crude oil into the desalting unit. It is extremely desirable to accomplish this preheating by using various process streams, which are associated with the fractional distillation process and which require cooling, to provide heat to the crude oil flowing to the desalting unit. Many times there will be a plurality of such process streams available at different locations and it is thus necessary to split the feed stream into a plurality of streams to take advantage of the heat available from various process steams. Manipulation of the flow of the split feed streams in such a manner that all of the split feed streams have substantially the same temperature prior to being recombined and introduced into the desalting unit provides substantially maximum utilization of the heat available from various process streams which are utilized to preheat the crude oil flowing to the desalting unit. It is thus an object of this invention to provide method and apparatus for maintaining the temperatures of the plurality of feed streams substantially equal at a point prior to the point where the plurality of feed streams are combined for introduction into the desalting unit.

Optimization of a fractional distillation process requires that specified quantities of crude oil must be available for introduction into the fractional distillation column. This implies that the flow rate of the effluent flowing from the desalting unit must be maintained at a level which will provide the quantities of crude oil required to provide the feed required by the fractional distillation process. It is thus another object of this invention to provide method and apparatus for maintaining a desired flow rate of the effluent flowing from the desalting unit.

Other process streams may be available for heating the effluent flowing from the desalting unit prior to introduction of the effluent flowing from the desalting unit into the fractional distillation column. If the feed stream flowing from the desalting unit is split to provide maximum utilization of the various process streams available, it is a further object of this invention to provide method and apparatus for maintaining the temperatures of the plurality of streams at a point prior to the point that the plurality of streams is combined for introduction into the fractional distillation column at substantially the same temperature to substantially maximize the usage of the heat available from various process streams utilized to heat the effluent flowing from the desalting unit.

In accordance with the present invention, method and apparatus is provided whereby the flow rate of the effluent flowing from a desalting unit is maintained at a desired level and the temperature of at least first and second crude oil feed streams flowing to the desalting unit are maintained substantially equal at a point prior to the point where the at least first and second crude oil feed streams are introduced into the desalting unit. If it is desired to split the effluent stream flowing from the desalting unit into at least first and second streams to heat the first and second streams prior to introducing the first and second streams into a fractional distillation column, method and apparatus is provided for maintaining the temperature of each of the at least first and second feed streams substantially equal at a point prior to the point where the at least first and second feed streams are introduced into a fractional distillation column.

Other objects and advantges of the invention will be apparent from the foregoing brief description of the invention and from the claims as well as from the drawing which is a diagrammatic representation of the desalting unit and the associated control system of the present invention.

For the sake of simplicity, the invention is illustrated and described in terms of splitting the feed stream flowing to the desalter and the effluent stream flowing from the desalter into only first and second streams. However, the invention is applicable to splitting the flows into more than two streams and is also applicable to more complex arrangements of heat exchangers than those illustrated.

A specific control system configuration is set forth in the drawings for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from pressure sensors or flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiments, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3(dE/dt)$$

where

S=output control signals;

E=difference between two input signals; and $K_1$, $K_2$ and $K_3$=constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual pressures equal. On the other hand, the same output signal could be scaled to represent a percentage or could be scaled to represent a temperature change required to make the desired and actual pressures equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameters. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

BRIEF DESCRIPTION OF THE FIGURE

The drawing illustrates a preferred schematic representation of the flow splitting and temperature control system of the invention.

Referring now to the drawing, a crude oil feed is supplied through conduit means 11. The crude oil feed flowing through conduit means 11 is split between conduit means 12 and conduit means 14. The feed flowing through conduit means 12 is provided to the heat exchanger 15. The heat exchanger 15 is provided with a heating fluid through conduit means 17. The heated feed flowing from the heat exchanger 15 is provided through the combination of conduit means 16 and 18 to the desalter unit 19 which may be any commercially available desalting unit such as are well known in the art of fractional distillation of crude oils.

The feed flowing through conduit means 14 is provided to the heat exchanger 21. The heat exchanger 21 is provided with a heating fluid through conduit means 22. The thus heated feed is provided from the heat exchanger 21 to the desalter 19 through the combination of conduit means 24 and 18.

The desalted crude oil flows from the desalter 19 through conduit means 31. The desalted crude oil flowing through conduit means 31 is split into two streams flowing through conduit means 32 and 33. The crude oil flowing through conduit means 32 is provided to the heat exchanger 34. The heat exchanger 34 is provided with a heating fluid through conduit means 36. The thus heated, desalted crude oil is provided from the heat exchanger 34 through the combination of conduit means 37 and 38 to the fractional distillation process. It is noted that the desalted crude oil flowing through conduit means 38 may be provided directly to the fractional distillation column or may be provided to a crude oil preheater or other processing steps if desired.

The described crude oil flowing through conduit means 33 is provided to the heat exchanger 41. The heat exchanger 41 is provided with a heating fluid through conduit means 42. The thus heated, desalted crude oil is provided from the heat exchanger 41 to the fractional distillation process through the combination of conduit means 44 and 38.

Flow transducer 51 in combination with the flow sensor 52, which is operably located in conduit means 31, provides an output signal 54 which is representative of the flow rate of the effluent flowing from the desalter 19 through conduit means 31. Signal 54 is provided from the flow transducer 51 to the multiplying block 55. The multiplying block 55 is also provided with a biasing term 56 which is responsive to the delay between the time required for a change in the flow of the feed through conduit means 12 and 14 to effect a change in th4e flow of the effluent flowing through conduit means 31. The manner in which signal 56 is established will be described hereinafter. Signal 54 is multipled by signal 56 to establish signal 58 which is representative of what the flow rate of the effluent flowing through conduit means 31 would be if the delay did not exist between the time the flow rate of the feed flowing through conduit means 12 and 14 changes and the time that the flow rate of the effluent flowing through conduit means 31 changes. Signal 58 is provided from the multiplying block 55 to the proportional-integral-derivative (P-I-D) controller 61. The P-I-D controller 61 is also provided with a set point signal 62 which is representative of the desired flow rate of the effluent flowing through conduit means 31. The P-I-D controller 61 provides an output signal 63 which is responsive to the difference between signals 62 and 58. Signal 63 is provided as an input to the gain block 64, the multiplying block 65 and the summing block 68.

The gain block 64 is utilized to adjust the control system during operation. Essentially, the gain block 64 may be utilized to adjust the magnitude of signal 56 until desired operation of the control system is achieved. Generally, the gain utilized is a steady-state process gain, representative of the unit change of flow in conduit means 31 divided by the unit change of flow in conduit means 12 and 14. Signal 66 is representative of signal 63 as modified by the gain block 64. Signal 66 is provided as an input to the lag 67. A lag provides a response which is similar to the response provided by a flow transducer in response to a step change. Thus, the lag 67 simulates the response which would be provided by the flow transducer 51 if no delay existed. The lag signal 69 is provided as an input to the delay 71 and is also provided to the numerator input of the dividing block 72. The delay provided by the delay block 71 is representative of the difference between the time that a flow rate change occurs for the feed flowing through conduit means 12 and 14 and the time that a resulting flow rate change occurs for the effluent flowing through conduit means 31. The delayed signal 74 is provided to the denominator input of the dividing block 72. Signal 69 is divided by signal 74 to establish signal 56. Essentially, when a change in the set point signal 62 occurs, the output signal 63 from the P-I-D controller 61 will immediately change. This immediate change will cause a gradual change in the magnitude of signal 69. This gradual change will be delayed to establish signal 74. When signal 69 is increasing, the magnitude of signal 56 will be greater than 1. When signal 69 is decreasing, the magnitude of signal 56 will be less than 1. Essentially, signal 56 will be of a magnitude such that, when multiplied by signal 54, the resulting signal is representative of what the flow rate of the effluent flowing through conduit means 31 would be if there was no delays in the system.

After a time, signal 69 will stabilize in the same manner as the flow rate of effluent through conduit means 31 would stabilize as the flow rate reaches the value of the set point signal 62. Signal 74 will stabilize at a later time. When both signals 69 and 74 have stabilized, signal 56 will assume a magnitude of 1 and control will be based directly on the magnitude of the flow rate signal 54. Use of the biasing term 56 provides a control technique by which oscillations in the flow rate of the effluent flowing through conduit means 31 may be prevented. Without the use of the biasing term 56, a change in the set point signal 62 would cause the flow rate of the feed flowing through conduit means 12 and 14 to change. However, signal 54 would indicate that the flow rate of the effluent flowing through conduit means 31 was not changing and the flow rate of the feed flowing through conduit means 12 and 14 would continue to be increased or decreased as required. When the flow rate of the effluent flowing through conduit means 31 finally did begin to change, the flow rate of the feed flowing through conduit means 12 or 14 would be too high or too low and an oscillatory effect would be present. Such oscillations are prevented by the use of the biasing term 56.

Temperature transducer 81 in combination with a temperature measuring device such as a thermocouple, which is operably located in conduit means 16, provides an output signal 82 which is representative of the temperature of the effluent flowing through conduit means 16. Signal 82 is provided from the temperature transducer 81 to the minuend input of the summing block 84. In like manner, temperature transducer 85 in combination with a temperature measuring device such as a thermocouple, which is operably located in conduit means 24, provides an output signal 86 which is representative of the temperature of the fluid flowing through conduit means 24. Signal 86 is provided from the temperature transducer 85 to the subtrahend input of the summing block 84. Signal 86 is subtracted from signal 82 to establish signal 87. Signal 87 is provided from the summing block 84 as an input to the P-I-D controller 89. The P-I-D controller 89 is also provided with a set point signal 91 which is preferably 0 so as to maintain the temperature of the fluid flowing through conduit means 16 and the temperature of the fluid flowing through conduit means 24 substantially equal. The P-I-D controller 89 establishes an output signal 92 which is responsive to the difference between signals 87 and 91. Signal 92 is provided from the P-I-D controller 89 as an input to the multiplying block 65. Signal 92 is scaled so as to be representative of the percentage of the feed flowing through conduit means 11 which must be provided through conduit means 12 to maintain the temperature of the fluid flowing through conduit means 16 substantially equal to the temperature of the fluid flowing through conduit means 24. Signal 92 is multiplied by signal 63 which is representative of the required total flow rate of the feed flowing through conduit means 11 to establish signal 94 which is representative of the required flow rate of the feed flowing through conduit means 12. Signal 94 is provided as a control signal to the pneumatic control valve 95 which is operably located in conduit means 12. The pneumatic control valve 95 is manipulated in response to signal 94 to thereby maintain a desired flow rate of feed through conduit means 12.

Signal 94 is also provided to the subtrahend input of the summing block 68. Signal 94 is subtracted from signal 63 to establish signal 97 which is representative of the required flow rate of the feed flowing through conduit means 14. Signal 97 is provided as a control signal to the pneumatic control valve 98 which is operably located in conduit means 14. The pneumatic control valve 98 is manipulated in response to signal 97 to thereby maintain the desired flow rate of feed through conduit means 14.

Control based on the presence of a control valve in both conduit means 12 and conduit means 14 is presently preferred to provide closer control of the splitting of the crude oil feed stream flowing through conduit means 11. However, one control valve could be utilized if desired with the splitting of the crude oil feed stream flowing through conduit means 11 being based only on signal 94. Signal 94 would be utilized to control either control valve 95 or 98 with the remaining control valve being deleted.

Temperature transducer 101 in combination with a temperature measuring device such as a thermocouple, which is operably located in conduit means 37, provides an output signal 102 which is representative of the temperature of the fluid flowing through conduit means 37. Signal 102 is provided from the temperature transducer 101 to the minuend input of the summing block 104. In like manner, the temperature transducer 105 in combination with a temperature measuring device such as a thermocouple, which is operably located in conduit means 44, provides an output signal 107 which is representative of the temperature of the effluent flowing through conduit means 44. Signal 107 is provided from the temperature transducer 105 to the subtrahend input of the summing block 104. Signal 107 is subtracted from signal 102 to establish signal 108. Signal 108 is provided from the summing block 104 as an input to the P-I-D controller 109. The P-I-D controller 109 is also provided with a set point signal 111 which is preferably 0 so as to maintain the temperature of the fluid flowing through conduit means 37 substantially equal to the temperature of the fluid flowing through conduit means 44.

The P-I-D controller 109 establishes an output signal 112 which is responsive to the difference between signals 108 and 111. Signal 112 is provided as an input to the flow controller 113. The flow transducer 114 in combination with the flow sensor 115, which is operably located in conduit means 33, establishes an output signal 116 which is representative of the flow rate of the fluid flowing through conduit means 33. Signal 116 is provided from the flow transducer 114 as an input to the flow controller 113. The flow controller 113 establishes an output signal 118 which is responsive to the difference between signals 112 and 116. Signal 118 is provided as an input to the pneumatic control valve 119 which is operably located in conduit means 33. The pneumatic control valve 119 is manipulated in response to signal 118 to thereby maintain a desired split of the fluid flowing through conduit means 31 so as to maintain the temperature of the fluid flowing through conduit means 37 substantially equal to the temperature of the fluid flowing through conduit means 44.

In summary, the control system of the present invention acts to maintain the temperatures of the split streams substantially equal after each stream has passed through the heat exchangers. The control system of the present invention also acts to maintain the flow rate of the effluent flowing from the desalter 19 substantially equal to a desired flow rate without oscillations occurring in the effluent flowing through conduit means 31.

The invention has been described in terms of a preferred embodiment as illustrated in the drawing. Specific components used in the practice of the invention as illustrated in the drawing such as flow sensors 52 and 115; flow transducers 51 and 114; temperature transducers 81, 85, 101 and 105; flow controller 113; pneumatic control valves 95, 98, and 119 are each well known, commercially available control components such as are described at length in Perry's *Chemical Engineer's Handbook*, 4th Edition, Chapter 22, McGraw-Hill.

The remaining elements of the control system illustrated in the drawing are preferably implemented on a digital computer. A suitable digital computer is the Optrol 7000 Process Computer System manufactured by Applied Automation, Inc., Bartlesville, Okla.

For reasons of brevity, other conventional equipment which would be present such as pumps, other heat exchangers, additional measurment-control devices, etc., have not been included in the above description as they play no part in the explanation of the invention.

While the invention has been described in terms of the presently preferred embodiments, reasonable variations and modifications are possible by those skilled in the art, within the scope of the described invention and the appended claims.

That which is claimed is:

1. Apparatus comprising:

means for splitting a crude oil feed stream into at least first and second feed streams;

a desalting means;

a first heat exchange means;

means for providing said first feed stream through said first heat exchange means to said desalting means;

a second heat exchange means;

means for providing said second feed stream through said second heat exchange means to said desalting means;

means for withdrawing crude oil from said desalting means;

means for establishing a first signal representative of the flow rate of the crude oil flowing from said desalting means;

means for establishing a second signal representative of the desired flow rate of the crude oil flowing from said desalting means;

means for establishing a biasing term which is responsive to the delay between the time said second signal is changed and the time said first signal changes in response to a change in said second signal;

means for multiplying said first signal by said biasing term to thereby establish a third signal which is representative of what the actual flow rate of the crude oil flowing from said desalting means would be if there were no delay between the time said second signal is changed and the time said first signal changes in response to a change in said second signal;

means for comparing said third signal and said second signal and for establishing a fourth signal responsive to the difference between said second signal and said third signal;

means for establishing a fifth signal which is representative of the percentage of said crude oil feed stream which must be provided as said first feed stream to said desalting means to maintain the temperature of said first feed stream after said first feed stream passes through said first heat exchange means substantially equal to the temperature of said second feed stream after said second feed stream passes through said second heat exchange means;

means for multiplying said fourth signal by said fifth signal to establish a sixth signal representative of the required flow rate of said first feed stream; and means for manipulating the flow rate of said first feed stream in response to said sixth signal.

2. Apparatus in accordance with claim 1 additionally comprising:

means for subtracting said sixth signal from said fourth signal to establish a seventh signal representative of the required flow rate of said second feed stream; and means for manipulating the flow rate of said second feed stream in response to said seventh signal.

3. Apparatus in accordance with claim 2 wherein said means for establishing said bias term comprises:

a lag means;

means for providing said fourth signal to said lag means to thereby establish an eighth signal;

a delay means;

means for providing said eighth signal to said delay means to thereby establish a ninth signal; and means for dividing said eighth signal by said ninth signal to establish said biasing term.

4. Apparatus in accordance with claim 2 wherein said means for establishing said fifth signal comprises:

means for establishing an eighth signal representative of the temperature of said first feed stream after said first feed stream passes through said first heat exchange means;

means for establishing a ninth signal representative of the temperature of said second feed stream after said second feed stream passes through said second heat exchange means;

means for establishing a tenth signal representative of the difference between said eighth signal and said ninth signal;

means for establishing an eleventh signal representative of the desired difference between said eighth signal and said ninth signal; and means for comparing said tenth signal and said eleventh signal to thereby establish said fifth signal.

5. Apparatus in accordance with claim 2 additionally comprising:

means for dividing the crude oil flowing from said desalting means into at least third and fourth feed streams;

a third heat exchange means;

means for passing said third feed stream through said third heat exchange means;

a fourth heat exchange means;

means for passing said fourth feed stream through said fourth heat exchange means;

means for establishing an eighth signal representative of the temperature of said third feed stream after said third feed stream passes through said third heat exchange means;

means for establishing a ninth signal representative of the temperature of said fourth feed stream after said fourth feed stream passes through said fourth heat exchange means;

means for establishing a tenth signal which is responsive to the difference between said eighth signal and said ninth signal;

means for establishing an eleventh signal representative of the desired difference between said eighth signal and said ninth signal;

means for comparing said tenth signal and said eleventh signal to establish a twelfth signal representative of the flow rate of said fourth feed stream required to maintain temperature of said third feed stream after said third feed stream passes through said third heat exchange means substantially equal to the temperature of said fourth feed stream after said fourth feed stream passes through said fourth heat exchange means;

means for establishing a thirteenth signal representative of the actual flow rate of said fourth feed stream;

means for comparing said twelfth signal and said thirteenth signal and for establishing a fourteenth signal which is responsive to the difference between said twelfth signal and said thirteenth signal; and means for manipulating the flow rate of said fourth feed stream in response to said fourteenth signal to thereby maintain the temperature of said third feed stream after said third feed stream passes through said third heat exchange means substantially equal to the temperature of said fourth feed stream after said fourth feed stream passes through said fourth heat exchange means.

6. In a process in which a crude oil feed stream flowing to a desalting process is split into at least first and second feed streams for the purpose of preheating said crude oil feed stream prior to introducing said crude oil feed stream into said desalting process, a method for controlling the flow rate of crude oil flowing from said desalting process and for maintaining the temperature of said first feed stream after preheating substantially equal to the temperature of said second feed stream after preheating, said method comprising the steps of:

establishing a first signal representative of the flow rate of the crude oil flowing from said desalting process;

establishing a second signal representative of the desired flow rate of the crude oil flowing from said desalting process;

establishing a biasing term which is responsive to the delay between the time said second signal is changed and the time said first signal changes in response to a change in said second signal;

multiplying said first signal by said biasing term to thereby establish a third signal which is representative of what the actual flow rate of the crude oil flowing from said desalting process would be if there were no delay between the time said second signal is changed and the time said first signal changes in response to a change in said second signal;

comparing said third signal and said second signal and establishing a fourth signal responsive to the difference between said second signal and said third signal;

establishing a fifth signal which is representative of the percentage of said crude oil feed stream which must be provided as said first feed stream to said desalting process to maintain the temperature of said first feed stream after said first feed stream is preheated substantially equal to the temperature of said second feed stream after said second feed stream is preheated;

multiplying said fourth signal by said fifth signal to establish a sixth signal representative of the required flow rate of said first feed stream; and manipulating the flow rate of said first feed stream in response to said sixth signal.

7. A method in accordance with claim 6 additionally comprising the steps of:

subtracting said sixth signal from said fourth signal to establish a seventh signal representative of the required flow rate of said second feed stream; and manipulating the flow rte of said second feed stream in response to said seventh signal.

8. A method in accordance with claim 7 wherein said step of establishing said bias term comprises:

lagging said fourth signal to thereby establish an eighth signal;

delaying said eighth signal to thereby establish a ninth signal; and dividing said eighth signal by said ninth signal to establish said biasing term.

9. A method in accordance with claim 7 wherein said step of establishing said fifth signal comprises:

establishing an eighth signal representative of the temperature of said first feed stream after said first feed stream is preheated;

establishing a ninth signal representative of the temperature of said second feed stream after said second feed stream is preheated;

establishing a tenth signal representative of the difference between said eighth signal and said ninth signal;

establishing an eleventh signal representative of the desired difference between sid eighth signal and said ninth signal; and comparing said tenth signal and said eleventh signal to thereby establish said fifth signal.

10. A method in accordance with claim 7 additionally comprising the steps of:

dividing the crude oil flowing from said desalting process into at least third and fourth feed streams;

heating said third and fourth feed streams;

establishing an eighth signal representative of the temperature of said third feed stream after said third feed stream has been heated;

establishing a ninth signal representative of the temperature of said fourth feed stream after said fourth feed stream has been heated;

establishing a tenth signal which is responsive to the difference between said eighth signal and said ninth signal;

establishing an eleventh signal representative of the desired difference between said eighth signal and said ninth signal;

comparing said tenth signal and said eleventh signal to establish a twelfth signal representative of the flow rate of said fourth feed stream required to maintain temperature of said third feed stream after said third feed stream has been heated substantially equal to the temperature of said fourth feed stream after said fourth feed stream has been heated;

establishing a thirteenth signal representative of the actual flow rate of said fourth feed stream;

comparing said twelfth signal and said thirteenth signal and for establishing a fourteenth signal which is responsive to the difference between said twelfth signal and said thirteenth signal; and manipulating the flow rate of said fourth feed stream in response to said fourteenth signal to thereby maintain the temperature of said third feed stream after said third feed stream has been heated substantially equal to the temperature of said fourth feed stream after said fourth feed stream has been heated.

* * * * *